US005162847A

United States Patent [19]

Watanabe

[11] Patent Number: 5,162,847

[45] Date of Patent: Nov. 10, 1992

[54] IMAGE FORMING APPARATUS

[75] Inventor: Hiroshi Watanabe, Yokohama, Japan

[73] Assignee: Kabushiki Kaisha Toshiba, Kawasaki, Japan

[21] Appl. No.: 853,643

[22] Filed: Mar. 18, 1992

[30] Foreign Application Priority Data

Mar. 29, 1991 [JP] Japan ..... 3-89016

[51] Int. Cl.[5] ..... G03G 15/00

[52] U.S. Cl. ..... 355/206; 355/201; 355/313

[58] Field of Search ..... 355/206, 201, 203-205, 355/313

[56] References Cited

U.S. PATENT DOCUMENTS 4,080,062 3/1978 Torigai et al. ..... 355/49
4,090,787 5/1978 Hubbard et al. .
4,315,685 2/1982 Inuzuka et al. .
4,344,697 8/1982 Matsumoto et al. .
4,501,485 2/1985 Tsudaka ..... 355/201

FOREIGN PATENT DOCUMENTS 61-34529 7/1986 Japan .

*Primary Examiner*—Richard L. Moses
*Attorney, Agent, or Firm*—Philip M. Shaw, Jr.

[57] ABSTRACT

A copying machine according to this invention is provided with a key counter and an all-clear function associated therewith. The machine is allowed to perform copying operation only when it is loaded with the key counter. When the key counter is removed, all copying conditions entered in the copying machine by a user are restored to the state before the start of the copying operation. Thus, production of undesired copies attributable to the user-set copying conditions used last can be prevented, so that the cost of copying can be reduced.

8 Claims, 4 Drawing Sheets

IMAGE FORMING APPARATUS

BACKGROUND OF THE INVENTION

1. Field of the Invention

This invention relates to an image forming apparatus, and more specifically, to an electrostatic copying machine in which image information on a document is focused on an image bearing member to form an electrostatic latent image thereon, and a copy image is obtained by developing the latent image.

2. Description of the Related Art

In general, a copying machine includes an image reading section, an image forming section, and a paper feeding section.

The image reading section includes a document table used to carry the document to be read thereon, an illumination unit for illuminating the document, and an optical system for transmitting the reflected light from the document. In the image reading section, an image on a document is illuminated, and a reflected light from the document is guided to an image bearing member.

The image forming section includes a photoconductor, i.e., the image bearing member, on which an electrostatic latent image is formed by means of the light from the image reading section, and which serves to reproduce the image of the document. The image forming section further includes a charging unit, developing device, transfer unit, fixing unit, cleaning unit, etc, as well as the photoconductor. The photoconductor, which is arranged for rotation, produces the electrostatic latent image corresponding to the light transmitted by means of the reading section. The charging unit is used to charge the photoconductor with electricity. The developing device develops the latent image on the photoconductor into a visible image. The transfer unit transfers the developed image to the copying material, and the fixing unit fixes the transferred image on the copying material. the cleaning unit is used to restore the photoconductor to its initial state.

The paper feeding section includes a plurality of paper cassettes for supplying the paper sheets, a paper feeder for feeding the paper sheets in the cassettes into the image forming section, and a discharge section for discharging each paper sheet having the copy image thereon. The paper feeding section is used to supply a copying material, e.g., sheet like plain paper, to the image forming section, transfer the image obtained in the image forming section to the plain paper, and discharge the resulting copy.

In the copying machine described above, a predetermined electric charge is applied to the photoconductor by means of the charging unit. Image information on the document, that is, the reflected light from the document, is transmitted through optical members, such as a plurality of return mirrors, a focusing lens, etc., to be focused on the surface of the photoconductor. This reflected light produces a charge distribution pattern or electrostatic latent image, which corresponds to the document image, on the photoconductor. The latent image is supplied with a developing agent, such as a toner, to be developed by means of the developing device, that is, it is copied as the image on the document. This toner image is transferred to the piece of the paper sheet fed from the paper feeder, the toner is fixed by means of the fixing unit, and the paper is discharged from the copying machine.

The copying machine of this type uses a conventional method for allowing only a specific user or users to make copies. One example of this method is disclosed in Published Examined Japanese Utility Model Application No. 61-34529. According to this method, copying is allowed by attaching an external device, such as a key counter, to the machine. This method is used in the case where many divisions have one copying machine for common use, so that the number of copies may have to be checked for each division, or that each division may be expected to bear the cost of copying depending on the number of copies made thereby.

If the key counter is used, copying operation is inhibited by removing it. In this case, however, the copying operation can be only inhibited, and copying conditions used last are maintained as they are. This implies that another user may be forced to use undesired copying conditions. If a copy starting signal is inputted without ascertaining that copying conditions to be newly used are different from the last-used ones, moreover, expendables such as the copying paper and toner will be wasted, thus entailing an increase in the cost of copying.

SUMMARY OF THE INVENTION

The object of this invention is to provide a copying machine capable of securely preventing undesired copying and improving a operating efficiency of the copying machine.

According to this invention, there is provided an image forming apparatus comprising means for forming an image on an image bearing member, means for changing an image forming condition of the forming means by selecting one condition among a reference condition and different conditions, means for controlling the image forming means on the basis of the conditions changed by the changing means, means for counting the number of image forming cycles executed by means of the forming means, the counting means being detachably mountable to the image forming apparatus, means for checking whether the counting means is mounted and for causing the controlling means to input an instruction for interrupting image forming operation when it is detected that the counting means is not mounted, and means for causing the controlling mean to change the present image forming condition, changed by means of the changing means, to the reference condition.

The image forming apparatus of this invention is provided with the counter means or key counter and an all-clear function associated therewith. The apparatus is allowed to perform copying operation only when it is loaded with the key counter. When the key counter is removed, all copying conditions entered in the apparatus by a user are restored to the state before the start of the copying operation. Even though copying conditions to be newly used are different from the ones used last, therefore, the last-used conditions cease to be maintained before a new copying cycle is started. Thus, waste of expendables, such as copying paper and toner, can be prevented, so that the cost of copying can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

An embodiment of this invention will now be described with reference to the accompanying drawings.

Figure 1:
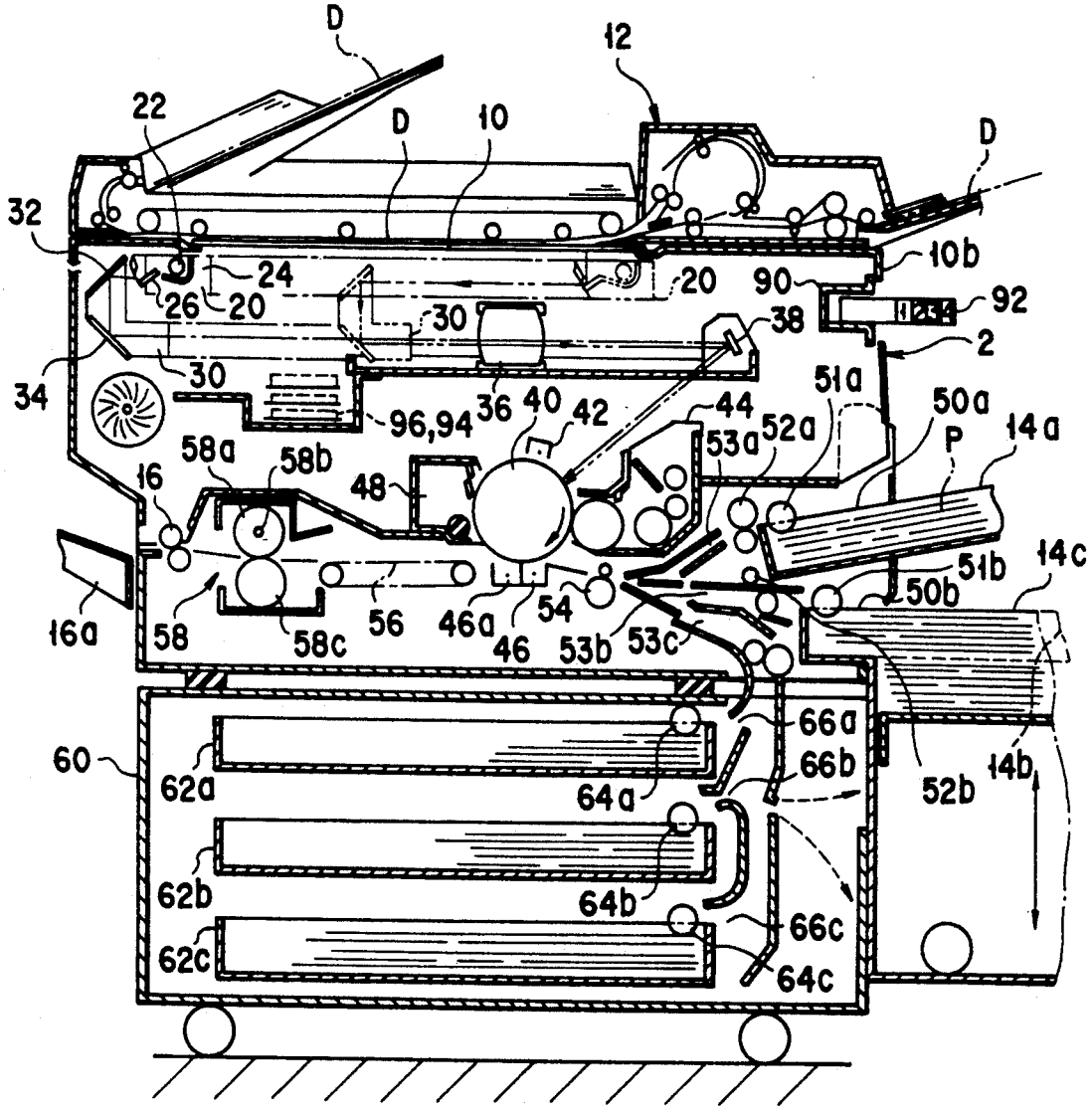
FIG. 1 is a sectional view showing a copying machine using an embodiment of this invention.

Referring to FIG. 1, there is shown in a copying machine (image forming apparatus) 2, which includes a document table 10 formed of a glass plate and carrying documents (copying objects) D thereon, an upper cover 10*b* surrounding the table 10, and an auto document feeder (hereinafter referred to as ADF) 12. The ADF 12, which is formed so as to be openable, feeds the documents D one after another to the table 10 so that each document D is closely in contact with the table. These elements 10, 10*b* and 12 are arranged at the top portion of the machine 2.

The cover 10*b* is provided with a control panel 18 (not shown in the sectional view of FIG. 1; see FIG. 3), through which a user inputs information for operating the copying machine 2, copy starting signal, etc. The control panel 18 includes a plurality of keys, e.g., a print key 18*a*, numeral keys 18*b*, a clear key 18*c*, an all-clear key 18*d*, etc. When the user turns on the print key 18*a*, a print starting signal is outputted. The numeral keys 18*b* are used to deliver numeral signals corresponding to numerics "0" to "9," which are indicative of the number of copies, copying-magnification data, etc. The clear key 18*c* outputs a signal to interrupt copying operation or restore data in the middle of entry to "0." The all-clear key 18*d* is used to stop all the copying operation and cancel a currently set copy mode, thereby restoring the machine 2 to its initial state. Further, the control panel 18 has a liquid crystal display (message display section, hereinafter referred to as LCD) 18*e*, a monitor LED 18*f*, etc., assembled integrally with one another. The LCD 18*e* displays the input data, such as the number of copies, the copying-magnification, etc., each step of procedure for the operation of the copying machine 2, exhaustion of paper sheets (copying material, mentioned later), timing for the resupply of a toner (mentioned later), error messages indicative of wrong ways of operating the machine 2, or the like. The monitor LED 18*f* is used to indicate operating conditions of the copying machine 2, e.g., ones related to paper cassettes (mentioned later). These conditions include, for example, the position of the cassette selected for the copying operation, occurrence and location of a paper jam in the machine 2, connection or disconnection of a counter connector 90 (in which is inserted a key connector 92 (mentioned later) used to allow only a specific user or users to make copies, or the like. Usually, the counter connector 90 is provided on or around the cover 10*b*.

Arranged inside the document table 10 (under the table as in FIG. 1) are first and second carriages 20 and 30, which optically transmit an image on the document D on the table 10 to a photoconductor 40 (mentioned later).

The first carriage 20 includes a lamp 22 for illuminating the document D, a reflector 24, and a primary mirror 26, assembled integrally with one another. The reflector 24 is used to converge illuminating lights emitted from the lamp 22 onto the document D. The mirror 26 is used to direct reflected light from the document D to the second carriage 30, which is arranged next to the first carriage 20. The second carriage 30 includes secondary and tertiary mirrors 32 and 34, which are integrally assembled so as to extend at right angles to each other. The mirrors 32 and 34 reflect the reflected light from the document D, directed thereto by the primary mirror 26, on the photoconductor 40.

The first and second carriages 20 and 30, which are movable substantially parallel to the table 10, are moved at a desired speed (which depends on the copying-magnification) along the table 10 by means of power transmission members, such as toothed belts (not shown), and a drive source, such as a pulse motor (not shown). In this case, as is generally known in connection with the cases of various other copying machines, the second carriage 30 is driven following the first carriage 20, and moves at half the speed of the carriage 20.

A focusing lens 36 and a fourth mirror 38 are arranged under the first carriage 20 and within a plan containing the optical axis of the reflected light from the tertiary mirror 34 (second carriage 30). The focusing lens 36, which can be moved by means of a drive mechanism (not shown), gives convergency to the reflected light. As it moves, the lens 36 gives a desired magnification to the reflected light. The fourth mirror 38, which can be moved along the optical axis by means of a drive mechanism (not shown), can return the reflected light from the lens 36 to a desired position on the photoconductor 40, and correct variation of the focal length which accompanies the movement of the lens 36.

The photoconductor 40 is located for rotation under the focusing lens 36 or near the center of the copying machine 2. As the reflected light is focused on the photoconductor 40, an electrostatic latent image (distribution pattern of electric charge) is formed thereon. A charging unit 42 and a developing device 44 are arranged around the photoconductor 40. The charging unit 42 is situated on the upper-course side of that position to which the reflected light is guided, with respect to the rotating direction. The unit 42 charges the photoconductor 40 to a desired level, in order to enable the latent image to be formed on the photoconductor 40 as the reflected light is applied thereto. The developing device 44 is situated on the lower-course side of that position to which the reflected light is guided, with respect to the rotating direction. The device 44 supplies the electrostatic latent image with the toner to develop the latent image, thereby forming a toner image (substantially identical with the image on the document D) on the photoconductor 40. Following the developing device 44, a transfer unit 46, AC unit 46*a*, cleaning unit 48, etc., are successively arranged around the photoconductor 40. The transfer unit 46 serves to transfer the toner image to each paper sheet fed from the paper cassette (mentioned later). The AC unit 46*a*, which is integrally incorporated in the transfer unit 46, is used to separate the sheet, electrostatically attracted to the photoconductor 40, from the photoconductor. The cleaning unit 48 scrapes off the toner which remains on the photoconductor 40 without having been transferred to the paper sheet, and electrically neutralizes the distribution of electric charge on the photoconductor 40, thereby initializing the charging property of the photoconductor.

Paper cassettes (hereinafter referred to as body cassettes) 14*a* and 14*b* are inserted in the right-hand portion of the copying machine 2, so as to be located corresponding to that portion of the photoconductor 40 which is situated between the developing device 44 and the transfer unit 46. The body cassettes 14*a* and 14*b* are used to feed paper sheets P, to which the toner image on the photoconductor 40 is to be transferred, to the region between the photoconductor 40 and the transfer unit 46. The cassettes 14*a* and 14*b* can be attached to and detached from slots 50*a* and 50*b* which are formed in the machine 2. These cassettes are utilized for supplying paper sheets in Folio (11×17 inches) or other sizes which, although suited for the production of a relatively small number of copies, are frequently used for copying.

In this embodiment, the slot 50*b* is fitted with a large-capacity cassette (hereinafter referred to as LCC) 14*c* in place of the cassette 14*b*. The LCC 14*c* has a capacity several times as large as the body cassettes 20 14*a* and 14*b*.

A paper feed pedestal (hereinafter referred to as PFP) 60 is disposed under the copying machine 2. The PFP 60, which is formed independently of the main body of the machine, serves both as a base bearing the machine 2 thereon and as a holder containing a plurality of types of paper cassettes therein.

The PFP 60, which contains inner cassettes 62*a*, 62*b* and 62*c*, includes frictional rollers 64*a*, 64*b* and 64*c* and a series of paper paths 66*a*, 66*b* and 66*c*. The rollers 64*a*, 64*b* and 64*c* are used to pick up the paper sheets one after another from the cassettes 62*a*, 62*b* and 62*c*, respectively. The paths 66*a*, 66*b* and 66*c*, which are formed of a pair of guide plates each, serve to guide the paper sheets, picked up by means of the rollers 64*a*, 64*b* and 64*c*, to that portion of the photoconductor 40 of the copying machine 2 which is situated between the developing device 44 and the transfer unit 46.

The paths 66*a*, 66*b* and 66*c* are arranged corresponding to the inner cassettes 62*a*, 62*b* and 62*c*, respectively. They guide the paper sheets delivered from the individual cassettes to the photoconductor 40 so that even the sheets from the lower-stage cassettes can be used in common. The paper sheet from the inner cassette 62*c*, for example, is passed through the paths 66*c*, 66*b* and 66*a* in the order named, to be directed to the photoconductor 40. The paper paths 66*a*, 66*b* and 66*c* can be exposed by removing the LCC 14*c* from the slot 50*b*. One of the paired guide plates is movable so that a paper jam can be easily removed.

First and second feed rollers 51*a* and 51*b*, first and second transfer rollers 52*a* and 52*b*, paper guides 53*a* and 53*b*, a connecting paper guide 53*c*, and a pair of timing rollers 54 are arranged between the photoconductor 40 and the body cassettes 14*a* and 14*b* (LCC 14*c*), inside the copying machine 2. The feed rollers 51*a* and 51*b* are used to pick up the paper sheets one after another from the body cassettes 14*a* and 14*b* (LCC 14*c*). The transfer rollers 52*a* and 52*b* are used to feed the sheets picked up by means of the rollers 51*a* and 51*b* to the photoconductor 40. The paper guides 53*a* and 53*b* are used to feed the sheets transported by means of the rollers 52*a* and 52*b* to the photoconductor 40. The connecting paper guide 53*c* allows the paper sheets supplied from the PFP 60 to be fed to the photoconductor 40. The timing rollers 54 serve to correct a skew of the piece of the paper sheets delivered thereto, and align the starting point of the reflected light projected on the photoconductor 40 with the leading head of the sheet.

A fixing unit 58, a paper moving mechanism 56, exit rollers 16, and a tray 16*a* are arranged in positions on the lower-course side of the transfer unit 46 beside the photoconductor 40 of the copying machine 2 (on the left-hand side of the machine 2 as in FIG. 1; each paper sheet is generally supplied through one end of the machine 2 and discharged through the other or opposite end). The fixing unit 58 fixes the transferred toner image (toner) on the paper sheet. The paper moving mechanism 56, which is situated between the fixing unit 58 and the transfer unit 46, moves the paper sheet, having the toner image thereon, toward the fixing unit 58. The exit rollers 16 serve to discharge the copied paper sheet, having the toner fixed thereon by means of the fixing unit 58, to the outside of the machine 2. The tray 16*a* receives and stores the copied sheet discharged by means of the rollers 16.

The fixing unit 58 includes a heat roller 58*a* and a pressure roller 58*c*. The roller 58*a* has a heater lamp 58*b* therein for generating heat used to melt the toner. The roller 58*c* is pressed against the roller 58*a* to apply pressure thereto. As the toner on the paper sheet, having the toner image thereon, is heated under pressure, it is fixed on the sheet.

As mentioned before, the copying machine 2 includes the counter connector 90 in which is inserted the key counter 92 used to allow only a specific user or users to make copies.

Figure 2:
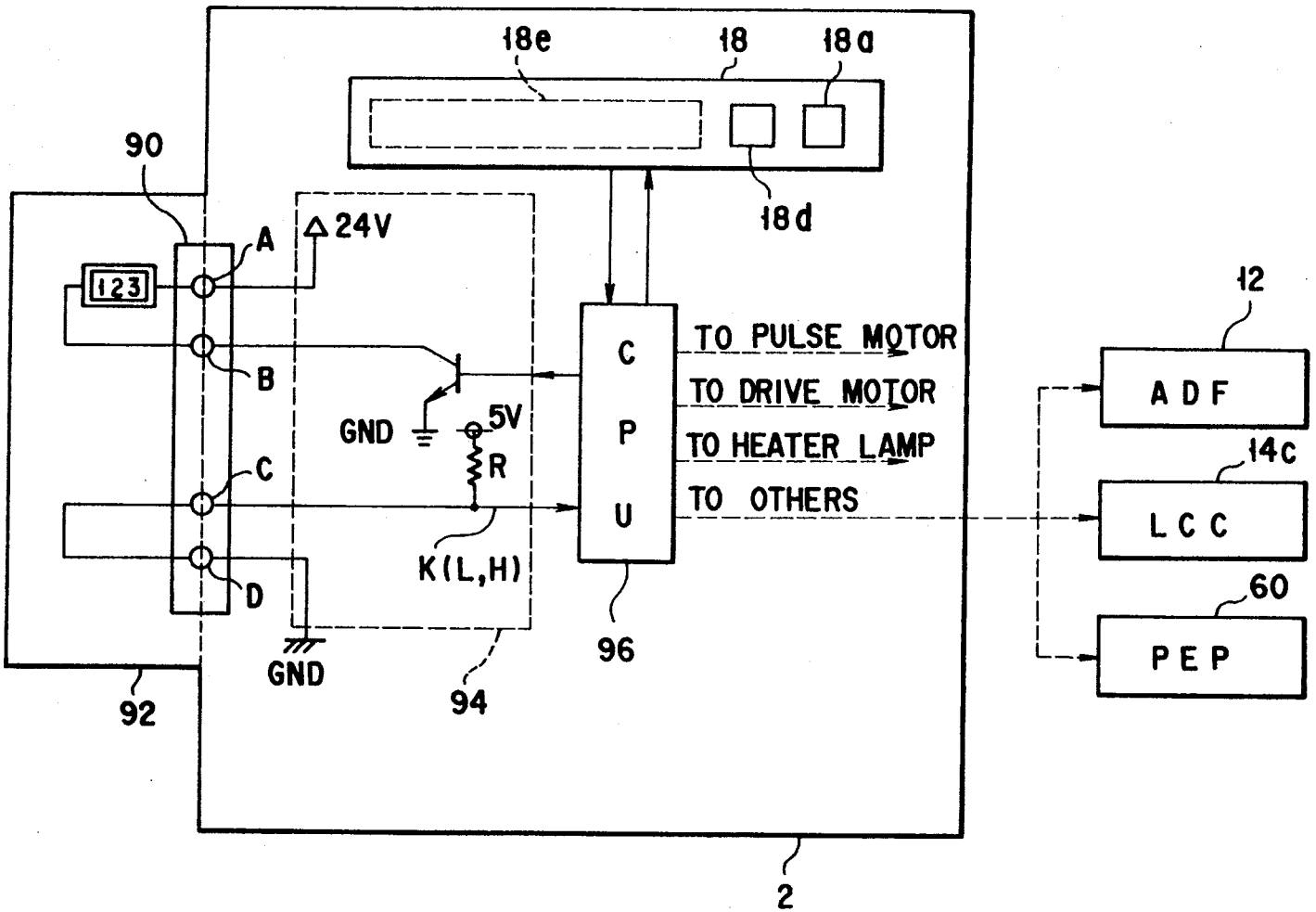
FIG. 2 is a block diagram showing an example of connection between a control section and a counter incorporated in the copying machine shown in FIG. 1.

As shown in FIG. 2, the connector 90 is connected to a counter discrimination circuit 94 with an L-shaped output as the counter 92 is inserted into the connector. When the counter 92 is inserted in the connector 90, pins A and B and pins C and D of the discrimination circuit 94 are connected to one another by means of the counter 92. The pins A and B, which are terminals for actuating the counter 92, cause the counter 92 to count "1" (add 1 to the value displayed on the counter) in response to an output signal from a copy number counter circuit (not shown), at the end of every copying cycle. A signal "H" for detecting the presence of the counter 92 is supplied between the pins C and D. When the counter 92 is inserted, a resistor R, the pin C, the counter 92, the pin D, and the ground form a circuit, so that an output K between the pins C and D is shifted from "H" to "L." At this point of time, the copy starting signal is allowed to be entered in a CPU 96.

When the counter 92 is drawn out, the output K between the pins C and D is restored from "L" to "K," so that the discrimination circuit 94 gives an instruction to the CPU 96 to inhibit the copying operation. Even when the print key 18*a* is turned on, in this case, the copying operation is inhibited. Also, a signal equivalent to an output signal from the all-clear key 18*d* of the control panel 18 is outputted, so that the copying machine 2 is restored to its initial state in which it is kept ready for copying with the power on. More specifically, the machine 2 is reset so that the copy scale factor is 100%, the copy number is 1, the copy density adjustment level is AE (auto expose mode), and the paper cassette for paper supply is the body cassette 14*a*, for example.

When the key counter 92 is off, a copy inhibiting message, e.g., "INSERT KEY COUNTER," is displayed on the LCD 18*e*.

When the key counter 92 is inserted, the copy inhibiting message disappears, and a copy wait message, e.g., "SET DOCUMENT," is displayed on the LCD 18*e*.

Figure 4:
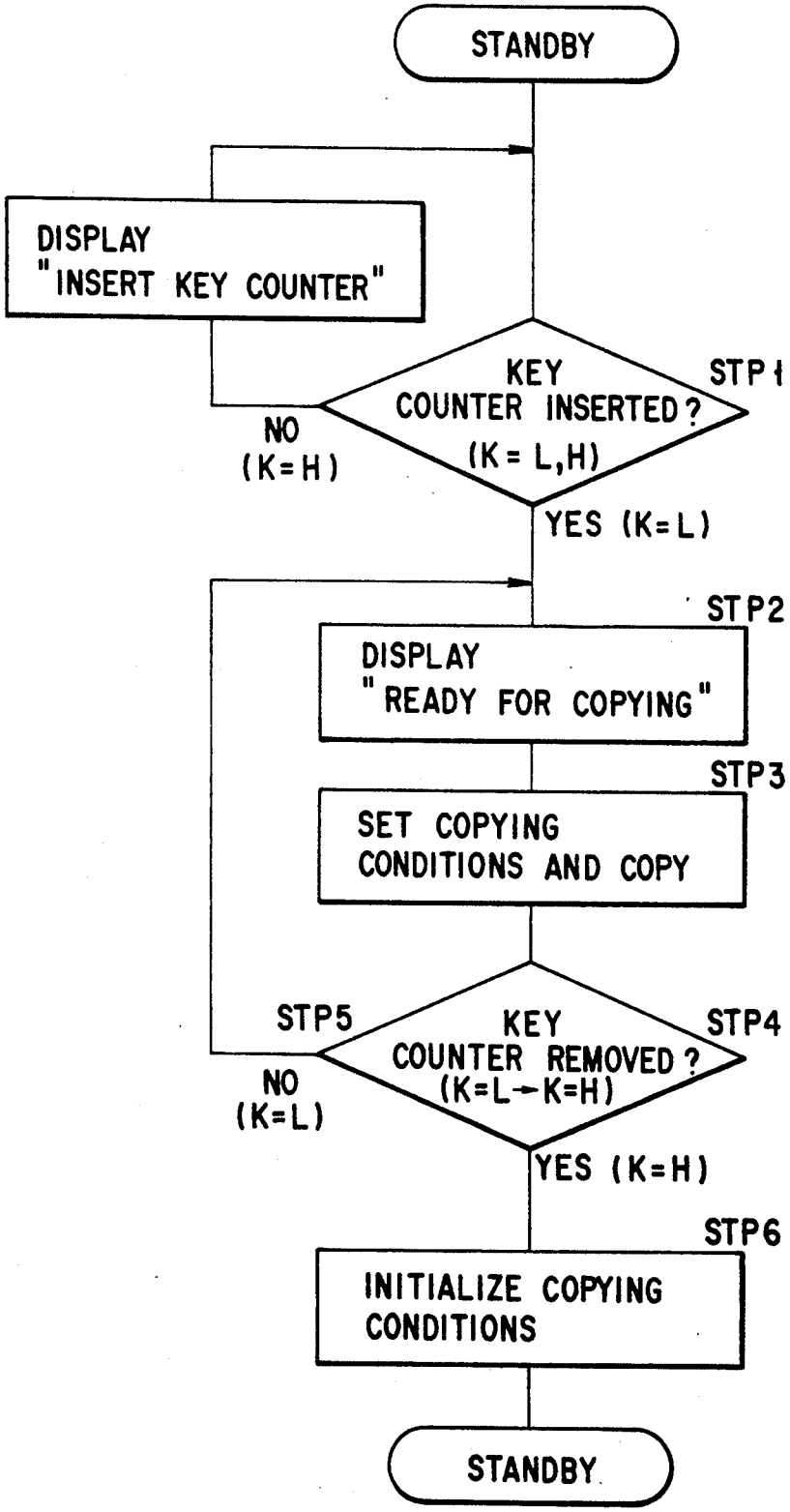
FIG. 4 is a flow chart showing an example of control in the copying machine shown in FIGS. 1 to 3.

More specifically, the following processes of operation are executed, as shown in FIG. 4.

(a) In response to a change of an output signal from the discrimination circuit 94, the signal K is turned on "L" from "H" , it is concluded that the key counter 92 is inserted in the copying machine 2 (STP 1).

(b) A message, such as "READY FOR COPYING" or "SET DOCUMENT," is displayed on the LCD 18*e* under the control of the CPU 96 (STP 2).

(c) Copying conditions, e.g., the copy number, 5, copying paper size, 8.25×11 inches, and copy scale factor, 65%, are inputted, the print key 18*a* is turned on, and a copying operation prescribed by the copying conditions is executed (STP 3).

(d) When the copying operation is finished, it is determined whether or not the key counter 92 is drawn out, the signal K is changed "H" from "L" (STP 4).

(e) The key counter 92 is kept in the connector 90, the signal K is held "L", the message such as "READY FOR COPYING" or "SET DOCUMENT" is displayed again. This message continues to be displayed until the counter 92 is drawn out (STP 5).

(f) When the key counter 92 is drawn out, the currently set copying conditions are cleared. Thus, the copy number, paper size, and copy scale factor are restored to 1, body cassette 14*a* , and 100%, respectively (STP 6).

(g) The copying machine 2 is kept on standby until the next entry.

Figure 3:
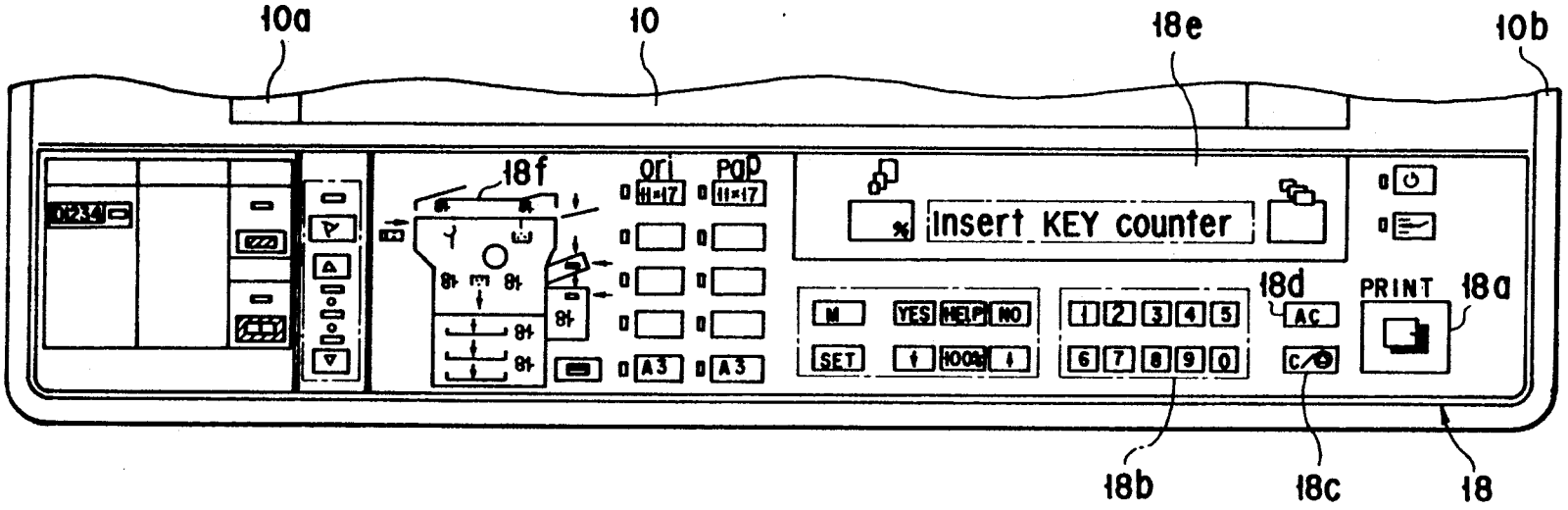
FIG. 3 is a schematic plan view showing a control panel incorporated in the copying machine shown in FIG. 1 and an example of display.

The following is a description of the operation of the copying machine 2 shown in FIGS. 1 to 3.

When a power switch (not shown) of the copying machine 2 is turned on, the heater lamp 58*b* is lit up to heat the fixing unit 58 to a desired temperature. At the same time, the pulse motor (not shown) is energized to move the first and second carriages 20 and 30 to their respective home positions or copy starting positions. When the fixing unit 58 is fully heated, a drive motor (not shown) is energized to rotate the photoconductor 40 and the developing device 44 at desired speeds. At this time, a desired electric charge is supplied from the charging unit 42 to the photoconductor 40, so that the charging property of the photoconductor 40 is stabilized, that is, the photoconductor 40 is warmed up. It is to be understood that all the operation is controlled by means of the CPU 96.

When the key counter 92 is off, the copy inhibiting message, such as "INSERT KEY COUNTER," is displayed on the LCD 18*e* of the control panel 18. When the counter 92 is already mounted, on the other hand, the copy wait message, such as "READY FOR COPYING" or "SET DOCUMENT," is displayed on the LCD 18*e* to inform the user that the machine 2 is ready for copying operation.

The operation will now be described on the assumption that the documents D are set in the ADF 12.

One of the documents D drawn out and fed to the document table 10 is brought closely into contact with the table 10 by means of the ADF 12. When the copy starting signal is inputted by means of the print key 18*a* after the copying conditions, such as the copying-magnification data, paper size, etc., are selected by operating the control panel 18, a linear region of the document D is illuminated by means of the lamp 22 and the reflector 24.

The reflected light from the document D passes through a slit region (elongated light transmitting region extending at right angles to the carriage moving direction), defined by means of the reflector 24, to be guided to the primary mirror 26, and is then reflected on the secondary mirror 32 of the second carriage 30.

The reflected light guided to the secondary mirror 32 is bent toward the tertiary mirror 34, and is reflected again by the mirror 34 to be directed to the focusing lens 36 in a position for a desired magnification. Then, the reflected light is converted into a convergent light by means of the lens 36, and is focused on the predetermined position on the photoconductor 40, previously charged to the predetermined level, by means of the fourth mirror 38.

The reflected light landed on the surface of the photoconductor 40 is converted into an electrostatic latent image. At this time, the first and second carriages 20 and 30 are moved at a predetermined speed in the sub-scanning direction (perpendicular to the main scanning direction or to the linear region which is defined as the reflected light passes through the slit region) by means of the pulse motor (not shown), which is driven at a fixed speed. Accordingly, image information, in the form of elongated strips of reflected light, is delivered in succession to the photoconductor 40, and converted into the electrostatic latent image.

If the copying-magnification is not 100%, the moving speed of the first carriage 20 with respect to the sub-direction, as well as that of the driven second carriage 30, must be changed depending on the magnification, so that the rotating speed of the pulse motor is continuously changed.

As the photoconductor 40 rotates at the desired speed, the latent image on the photoconductor 40 is guided to a developing region in which the developing device 44 is located. In this developing region, the toner is selectively supplied from the developing device 44 to the latent image, whereby the latent image is converted into a toner image.

In parallel with these processes of operation, one cassette which contains paper sheets of an optimum size is selected among the cassettes 14*a* and 14*b* (LCC 14*c* ) and the inner cassettes 62*a*, 62*b* and 62*c* of the PFP 60, depending on the detected document size and the copying-magnification. As the specific cassette is selected in this manner, the drive motor (not shown) is energized, so that one of the paper sheets is drawn out by means of the feed rollers provided individually for the cassettes (LCC or PFP). This drawn-out paper sheet is fed through the transfer rollers, paper paths, and timing rollers 54 to a transfer region between the photoconductor 40 and the transfer unit 46.

It is to be understood that the paper sheet drawn out in this manner is temporarily stopped by means of the timing rollers 54, and is fed to the photoconductor 40 in a manner such that the start of movement of the first or second carriage 20 or 30 with respect to the sub-scanning direction is used as a reference, that is, the leading end of the toner image formed on the photoconductor 40 and the leading head of the paper sheet are in alignment with each other.

The paper sheet aligned with the toner image (movement of the photoconductor 40) by means of the timing rollers 54 is attracted by electric charge remaining on the photoconductor 40, and is bonded to the photoconductor 40. In this case, an electric charge of the same polarity as the one previously supplied from the transfer unit 46 to the photoconductor 40 for latent image formation is supplied to the photoconductor 40 and the paper sheet. Thus, the toner image is transferred from the photoconductor 40 to the sheet.

The paper sheet, having the toner image thereon, is disengaged from the photoconductor 40 by means of an AC voltage which is applied to the photoconductor 40 by means of the AC unit 46*a* and serves to neutralize the applied electric charge. Then, the paper sheet is transported to the position between the heat roller 58*a* and the pressure roller 58*c* of the fixing unit 58 by means of the paper moving mechanism 56, and is heated under pressure. As a result, the toner image is fixed on the paper sheet.

The paper sheet, having the copy image of the document D thereon, is discharged onto the tray 16*a* with its copy surface upward.

After the toner image is transferred to the paper sheet, the photoconductor 40 continues to be rotated, and is cleaned by means of the cleaning unit 48. Thus, the toner remaining on the photoconductor 40 without having been transferred to the paper sheet is removed, and the charge distribution pattern on the surface is restored its initial state to be ready for the next copying cycle. This copying process and change of the documents D are repeated corresponding to the copy number and the number of documents D.

When all the copying (image forming) operation is finished, the message, such as "READY FOR COPYING" or "SET DOCUMENT," is displayed again on the LCD 18*e*. When the key counter 92 is drawn out, all the copying conditions entered for the copying operation are deleted, and the copy inhibiting message, such as "INSERT KEY COUNTER," is displayed on the LCD 18*e*. In any situation, the copying machine 2 is kept ready or warmed up.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for forming an image on an image bearing member;

means for changing an image forming condition of the forming means by selecting one condition among a reference condition and different conditions;

means for controlling the image forming means on the basis of the conditions changed by the changing means;

means for counting the number of image forming cycles executed by means of the forming means, the counting means being detachably mountable to the image forming apparatus;

means for checking whether the counting means is mounted and for causing the controlling means to input an instruction for interrupting image forming operation when it is detected that the counting means is not mounted; and means for causing the controlling means to change the present image forming condition, changed by means of the changing means, to the reference condition.

2. An image forming apparatus according to claim 1, wherein said causing means includes an outputting means for delivering first and second control signals through the causing means to the controlling means when the counting means is mounted to the checking means, and the second control signal lower in level than the first control signal is delivered through the causing means to the controlling means when the counting means is not mounted to the checking means.

3. An image forming apparatus according to claim 2, wherein said controlling means determines which of the first and second control signals is delivered.

4. An image forming apparatus according to claim 1, wherein said controlling means and said causing means are constructed electrically as a single circuit.

5. An image forming apparatus according to claim 3, wherein said forming means includes a display device for displaying the image forming conditions and the operating state thereof, and said controlling means causes the display device to display a message indicative of the permission or inhibition of the image forming operation, in accordance with the instruction from the causing means.

6. An image forming apparatus according to claim 5, wherein said controlling means causes the display device to display a message for the mount of the counting means to the checking means when an instruction for the inhibition of the image forming operation is inputted by means of the checking means.

7. An image forming apparatus comprising:

means for forming an image on an image bearing member;

means for inputting image forming conditions in which the image forming means forms the image, the input means including a display device, capable of displaying the image forming conditions for the forming means and the operating state thereof, and first counter means for counting the total cycles of image forming operation;

second counter means, different from the first counter means, for counting the number of image forming cycles executed by means of the forming means, the second counter means being detachably mountable from the forming means;

means, having terminals which are applied with a predeterminal voltage having a level H, for detecting that the second counter means is mounted to the forming means through a detection of the voltage applied to the terminals being changed from the level H to level L; and means for controlling a copy inhibiting signal to the forming means and causing the display device of the input means to display a message for the mount of the second counter means when the level L is detected by means of the detecting means.

8. An image forming apparatus according to claim 7, wherein said control means and said detecting means are constructed electrically as a single circuit.

* * * * *